US005170908A

United States Patent [19]

Austin

[11] Patent Number: 5,170,908

[45] Date of Patent: Dec. 15, 1992

[54] EATING PLATE HAVING A HOLE FOR A BEVERAGE CONTAINER WITH SLOTS FOR UTENSILS

[76] Inventor: Vincent P. Austin, 1 Russell St., Wallingford, Conn. 06492

[21] Appl. No.: 657,077

[22] Filed: Feb. 19, 1991

[51] Int. Cl.[5] ..... B65D 83/10

[52] U.S. Cl. ..... 220/574; 206/563; 220/737; 220/756

[58] Field of Search ..... 206/563; 220/574, 94 B

[56] References Cited

U.S. PATENT DOCUMENTS 2,512,963 6/1950 Peiker ..... 206/563
3,025,948 3/1962 Appelt ..... 206/563
3,883,029 5/1975 Wyatt ..... 220/23.83
4,607,758 8/1986 Stevens ..... 220/23.83
4,658,957 4/1987 Guth et al. ..... 206/563

*Primary Examiner*—Joseph Man-Fu Moy
*Attorney, Agent, or Firm*—DeLio & Associates

[57] ABSTRACT

An eating plate with: a hole to receive a beverage container with a flange; a handle; slots to receive a fork, knife and spoon; and a hole to receive a napkin. A beverage container with a flange to fit into the hole in this eating plate. A knife, a fork, and a spoon to fit into the slots in this eating plate.

3 Claims, 3 Drawing Sheets

FIG. 1
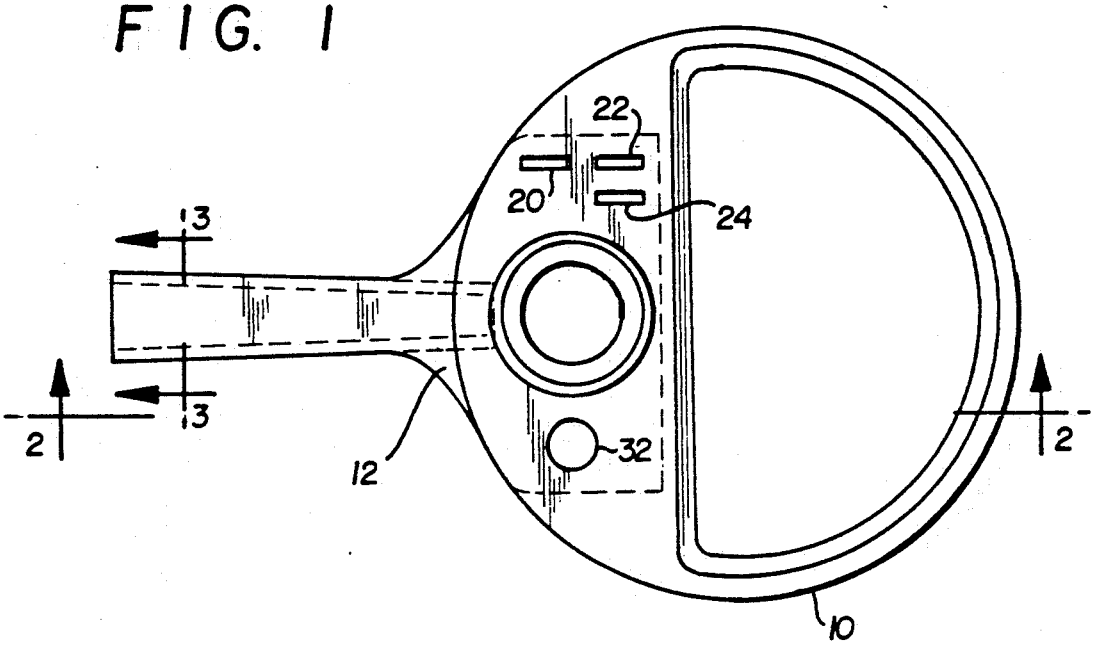
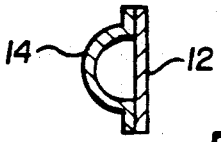
FIG. 3
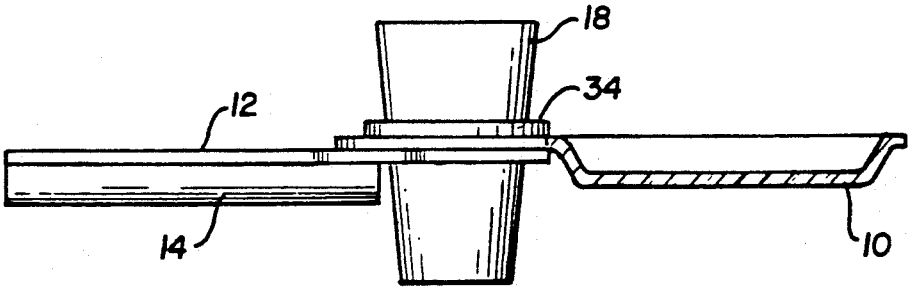
FIG. 2

FIG. 4
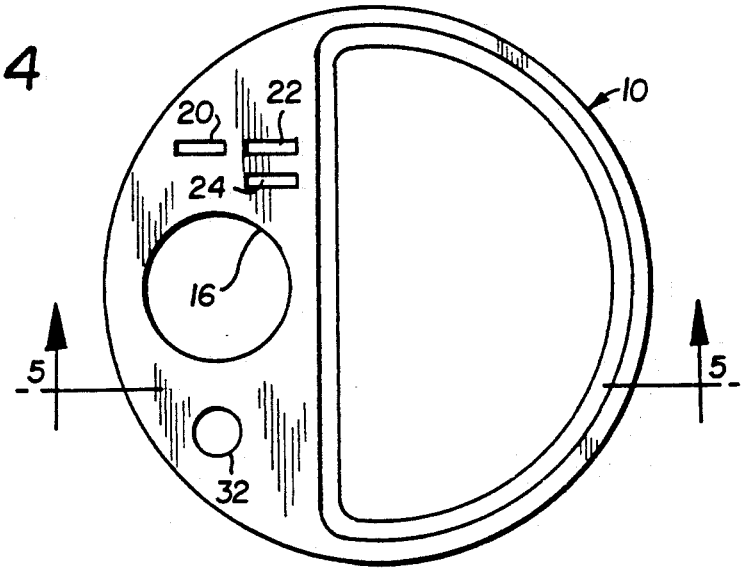
FIG. 5
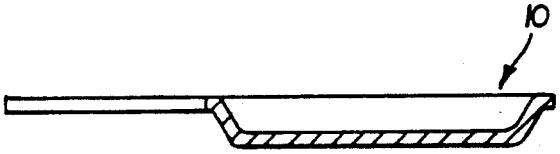
FIG. 11
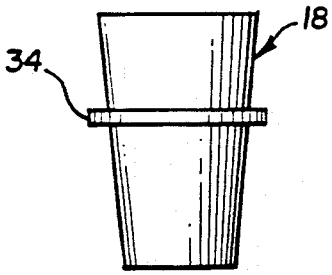
FIG. 13
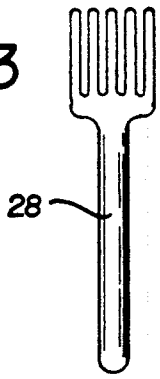
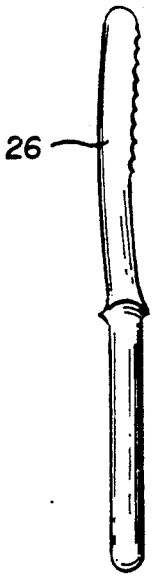
FIG. 12
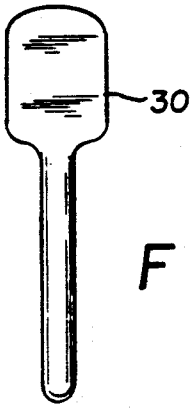
FIG. 14

FIG. 6
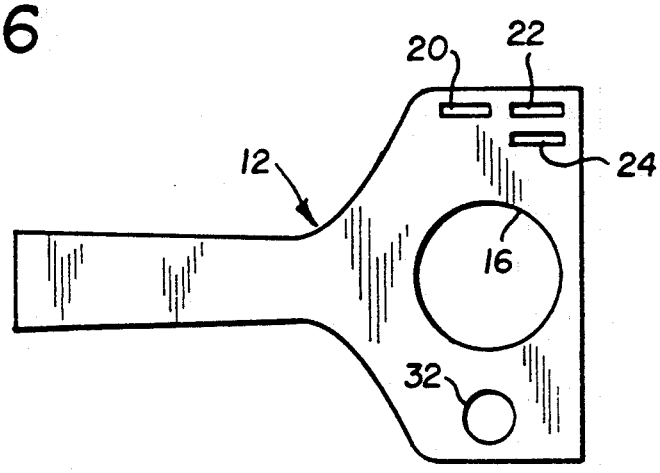
FIG. 7
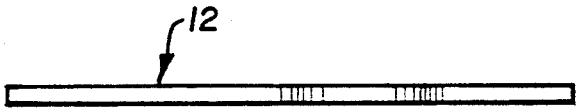
FIG. 8
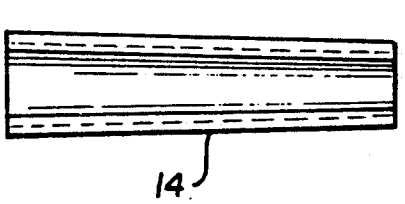
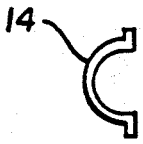
FIG. 9
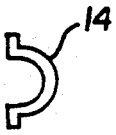
FIG. 10

EATING PLATE HAVING A HOLE FOR A BEVERAGE CONTAINER WITH SLOTS FOR UTENSILS

BACKGROUND OF THE INVENTION

1. Field of the Invention

This invention relates to an eating plate, and more particularly to an eating plate adapted to be held while eating therefrom and having a hole to suspend a beverage container and slots for a fork, knife and spoon.

2. Description of the Prior Art

While attending picnics, cocktail parties and other functions where foods and beverages are served, it is extremely awkward to balance a plate of food and a beverage with one hand and eat and drink without a great risk of spillage. The situation usually necessitates putting the plate or the beverage on the floor or ground. There are times when a used or partially used beverage container is found in an inconspicuous space at a considerably later time.

To solve this problem, an eating plate with a hole in it to receive an easily removeable beverage container is provided. The beverage container has a flange to fit in the hole in the plate. Optionally, a handle is provided for holding the plate and slot locations are provided from which a fork, knife or spoon can be suspended.

SUMMARY OF THE INVENTION

The invention comprises an eating plate divided into a plate area for supporting food and a holding area having a hole adapted to receive and support a beverage container by suspending it from the edges of the hole. A plurality of slots are preferably provided adapted to hold eating utensils by suspending the utensils from the edges of the slot.

A handle section may optionally be provided, connected to the eating plate, providing a convenient way to hold the eating plate, and a second hole may be provided to hold a napkin.

BRIEF DESCRIPTION OF THE DRAWING

FIG. 1 is a plan view of the preferred embodiment of the invention.

FIG. 2 is a side elevation view of the eating plate, partially in cross section, along the line 2—2 in FIG. 1.

FIG. 3 is a cross sectional view of the handle along the line 3—3 in FIG. 1.

FIG. 4 is a plan view showing only the plate section component of the embodiment seen in FIG. 1.

FIG. 5 is a side elevational view of the plate section, partially in cross section along the line 5—5 in FIG. 4.

FIG. 6 shows the handle section component of the plate.

FIG. 7 is a side elevation view of the handle section component seen in FIG. 6.

FIG. 8 is a top plan view of the handle base.

FIGS. 9 and 10 are left and right side elevation views of the handle base in FIG. 8.

FIG. 11 is a beverage container with a flange according to the present invention.

FIGS. 12, 13 and 14 show a knife, fork and spoon, respectively, to be hung from the utensil slots in FIG. 1.

DESCRIPTION OF THE PREFERRED EMBODIMENT

The preferred embodiment of the invention is shown fully assembled in FIGS. 1, 2 and 3, and comprises a plate section 10 (shown separately in FIGS. 4 and 5), a handle section 12 (shown separately in FIGS. 6 and 7) and a handle base 14 (shown separately in FIGS. 8, 9 and 10). The eating plate may be made of any material commonly used in the manufacture of eating plates which are well known to those skilled in the art.

As may be seen in FIGS. 1, 4 and 6, the handle base 12 is assembled to the underside of a flattened holding area portion of the plate section 10 and includes a central opening 16 for beverage container 18 (as seen in FIG. 11), a plurality of slots 20, 22, 24 for the knife 26, fork 28 and spoon 30 as seen in FIGS. 12, 13 and 14. A napkin hole 32 is also provided to conveniently hold a napkin.

In a conventional manner, the eating plate includes a slightly recessed plate area to hold foods.

The beverage container 18 is preferably provided with a flange 34 surrounding the container 18 at a point above its center of gravity for proper suspension. The knife, fork and spoons, in FIGS. 12-14 are provided with wide shoulders at the junction of the eating portion, i.e., tines, blade or spoon bowl, which rest on the edges of slots 20-24.

Accordingly, what is claimed is:

1. An eating plate comprising:

a plate section divided into a plate area for supporting food and a holding are having a hole adapted to receive and support a beverage container by suspending it from the edges of the hole and a plurality of slots adapted to receive and support a plurality of eating utensils by suspending the utensils from the edges of the slot; and a handle section connected to the holding area, the handle section having a hole adapted to receive a beverage container and a plurality of slots adapted to receive a plurality of eating utensils, the hole and slots in the handle section being aligned with the hole and slots in the plate section.

2. An eating plate according to claim 1 further comprising a handle base connected to the handle section.

3. An eating plate according to claim 1 wherein the handle section and the holding area of the plate section each includes a napkin hole, said napkin holes being aligned relative to one another to receive and support a napkin.

* * * * *

UNITED STATES PATENT AND TRADEMARK OFFICE

CERTIFICATE OF CORRECTION

PATENT NO. : 5,170,908

DATED : December 15, 1992

INVENTOR(S) : Vincent P. Austin

It is certified that error appears in the above-identified patent and that said Letters Patent is hereby corrected as shown below:

In the Claims

Column 2, line 39 "are" should read --area--.

Signed and Sealed this

Sixteenth Day of November, 1993

Bruce Lehman

*Attest:*

BRUCE LEHMAN

*Attesting Officer*

*Commissioner of Patents and Trademarks*